US009947502B2

(12) United States Patent
Hemberg et al.

(10) Patent No.: US 9,947,502 B2
(45) Date of Patent: Apr. 17, 2018

(54) ALIGNING AND FOCUSING AN ELECTRON BEAM IN AN X-RAY SOURCE

(71) Applicant: Excillum AB, Kista (SE)

(72) Inventors: Oscar Hemberg, Kista (SE); Tomi Tuohimaa, Kista (SE); Björn Sundman, Kista (SE)

(73) Assignee: EXCILLUM AB, Kista (SE)

( * ) Notice: Subject to any disclaimer, the term of this patent is extended or adjusted under 35 U.S.C. 154(b) by 98 days.

(21) Appl. No.: 15/147,394

(22) Filed: May 5, 2016

(65) Prior Publication Data

US 2016/0247656 A1 Aug. 25, 2016

Related U.S. Application Data

(63) Continuation of application No. 13/884,447, filed as application No. PCT/SE2011/051557 on Dec. 21, 2011, now Pat. No. 9,380,690.

(30) Foreign Application Priority Data

Dec. 22, 2010 (SE) ..... 1051369

(51) Int. Cl.

| | |
|---|---|
| ***H05G 1/52*** | (2006.01) |
| ***H01J 35/14*** | (2006.01) |
| ***H01J 35/08*** | (2006.01) |

(52) U.S. Cl.

CPC ..... *H01J 35/14* (2013.01); *H01J 35/08* (2013.01); *H05G 1/52* (2013.01); *H01J 2235/082* (2013.01)

(58) Field of Classification Search

CPC ..... H01J 2235/082; H01J 35/08; H01J 35/14; H05G 1/52

See application file for complete search history.

(56) References Cited

U.S. PATENT DOCUMENTS

| | | | |
|---|---|---|---|
| 2,665,390 | A | 1/1954 | Zunick et al. |
| 4,631,741 | A | 12/1986 | Rand et al. |
| 4,978,856 | A | 12/1990 | Akado |

(Continued)

FOREIGN PATENT DOCUMENTS

| | | | |
|---|---|---|---|
| CN | 101490790 | A | 7/2009 |
| EP | 1501339 | A1 | 1/2005 |

(Continued)

OTHER PUBLICATIONS

Extended European Search Report dated Oct. 4, 2016, issued by the European Patent Office in corresponding European Application No. EP 16175161.5-1556 (5 pages).

(Continued)

*Primary Examiner* — Glen Kao

(74) *Attorney, Agent, or Firm* — Buchanan Ingersoll & Rooney P.C.

(57) ABSTRACT

A technique for indirectly measuring the degree of alignment of a beam in an electron-optical system including aligning means, focusing means and deflection means. To carry out the measurements, a simple sensor may be used, even a single-element sensor, provided it has a well-defined spatial extent. When practiced in connection with an X-ray source which is operable to produce an X-ray target, further, a technique for determining and controlling a width of an electron-beam at its intersection point with the target.

20 Claims, 7 Drawing Sheets

(56) References Cited

U.S. PATENT DOCUMENTS

| | | | |
|---|---|---|---|
| 5,039,923 | A | 8/1991 | Ogino et al. |
| 5,877,505 | A | 3/1999 | Fujino |
| 9,380,690 | B2 * | 6/2016 | Hemberg |
| 2007/0120065 | A1 | 5/2007 | Takane et al. |
| 2007/0216767 | A1 | 9/2007 | Kojima |
| 2008/0283778 | A1 | 11/2008 | Tomimatsu et al. |
| 2009/0141864 | A1 | 6/2009 | Hertz et al. |

FOREIGN PATENT DOCUMENTS

| | | | |
|---|---|---|---|
| GB | 711 691 | A | 7/1954 |
| GB | 1 211 227 | | 11/1970 |
| GB | 1 602 011 | A | 11/1981 |
| JP | 61-294745 | A | 12/1986 |
| JP | 01-255142 | A | 10/1989 |
| JP | 04-104439 | A | 4/1992 |
| JP | 09-190788 | A | 7/1997 |
| JP | 2002-216684 | A | 8/2002 |
| JP | 2003-344596 | A | 12/2003 |
| JP | 2009-537062 | A | 10/2009 |
| WO | 2005079246 | A2 | 9/2005 |
| WO | WO 2007/133144 | A1 | 11/2007 |
| WO | 2010/067260 | A1 | 6/2010 |
| WO | WO 2010/112048 | A1 | 10/2010 |

OTHER PUBLICATIONS

International Search Report (PCT/ISA/210) dated Dec. 22, 2010, by the Swedish Patent Office as the International Searching Authority for International Application No. PCT/SE2011/051557.

Written Opinion (PCT/ISA/237) dated Dec. 22, 2010, by the Swedish Patent Office as the International Searching Authority for International Application No. PCT/SE2011/051557.

Hemberg et al., "Liquid-Metal-Jet Anode X-Ray Tube" Optical Engineering, Society of Photo-Optical Instrumentation Engineers, (Jul. 1, 2004), vol. 43, No. 7, pp. 1682-1688.

An English Translation of the First Office Action dated May 7, 2014, by the Japan Patent Office in corresponding Japanese Patent Application No. 2013-544434. (5 pages).

First Office Action dated May 3, 2017, by the State Intellectual Property Office of People's Republic of China in corresponding Chinese Patent Application No. 201610033696.7, and an English Translation of the Office Action. (10 pages).

* cited by examiner $U_{22}$
22
28
$U_{28}$
+
-
$I_1$
$I_1'$
$I_1''$
$w_1$
J
$f_1$

E
A
B
$U_{28}$

E=0
A
B
$U_{22}$
$U_{28}$

ALIGNING AND FOCUSING AN ELECTRON BEAM IN AN X-RAY SOURCE

CROSS REFERENCE TO RELATED APPLICATIONS

The present application is a continuation of U.S. application Ser. No. 13/884,447, filed on May 9, 2013, which is a U.S. national stage of International Application No. PCT/SE2001/051557, filed on Dec. 21, 2011, which claims the benefit of Swedish Application No. 1051369-5, filed on Dec. 22, 2010. The entire contents of each of U.S. application Ser. No. 13/884,447, International Application No. PCT/SE2001/051557, and Swedish Application No. 1051369-5 are hereby incorporated herein by reference in their entirety.

TECHNICAL FIELD OF THE INVENTION

The invention disclosed herein generally relates to automatic calibration of electron-optical systems. More precisely, the invention relates to devices and methods for automatically aligning and/or focusing an electron beam in an electron-impact X-ray source, in particular a liquid-jet X-ray source.

BACKGROUND OF THE INVENTION

The performance of an optical system is usually optimal for rays travelling along an optical axis of the system. Therefore, the assembly of an optical system often includes careful alignment of the components to make the radiation travel as parallel and/or as close to the optical axis as the circumstances admit. Proper alignment is generally desirable in optical systems for charged particles as well, e.g., in electron-optical equipment.

The electron beam in a high-brilliance X-ray source of the electron-impact type is required to possess a very high brilliance. It is typically required that the electron beam spot be positionable with high spatial accuracy. As one example, the applicant's co-pending application, published as WO 2010/112048, discloses an electron-impact X-ray source in which the electron target is a liquid metal jet. The electron beam which is to impinge on the jet typically has a power of about 200 W and a focus diameter of the order of 20 μm. If the electron gun includes consumption parts, such as a high current density cathode with a limited life span, then the X-ray source may need to be disassembled regularly to allow these parts to be replaced. The subsequent reassembly may have to be followed by a fresh alignment procedure, at considerable work and/or standstill costs. A need for realignment may also arise if the X-ray source is moved physically, is subject to external shocks or maintenance.

SUMMARY OF THE INVENTION

The present invention has been made with respect to the above limitations encountered in electron-optical systems in general and electron guns in particular. Thus, it is an object of the invention to provide alignment and calibration techniques for electron-optical systems which are more convenient to operate. It is envisaged that the invention will, as a consequence, help such systems operate more economically and/or more accurately. It is a particular object to provide improved alignment and calibration techniques for electron-optical systems supporting X-ray sources or operating as integral parts of these.

An electron-optical system in an electron-impact X-ray source may be adapted to receive an incoming electron beam and to supply an outgoing beam which is focused and/or directed in a manner suitable to produce X-ray radiation when impinging on an electron target located in the electron beam path, this intersection defining the interaction region of the X-ray source. The electron-optical system may comprise aligning means for adjusting a direction of the incoming electron beam and at least one deflector for adjusting a direction of the outgoing electron beam. The deflection range is the set of angles over which the direction of the outgoing electron beam is allowed to vary. The aligning means is responsible for compensating a skew or off-axis position of the incoming beam, so that it travels in an aligned manner through the electron-optical system. The aligning means may be operable to deflect the incoming electron beam one-dimensionally or two-dimensionally. Misalignment of the incoming electron beam may arise, for instance, if the electron-optical system is dislocated with respect to an electron source producing the electron beam. The aligning means may for instance be of an electro-optical or mechanical type. Two aligning means of different types may be combined. It is known that two aligning means which are independently controllable and suitably spaced are able to compensate a skew and an off-axis misalignment even if these occur simultaneously. Further, the electron-optical system may comprise focusing means for focusing the outgoing electron beam at or around the interaction region.

Each of the aligning means and deflector may be embodied as a device operable to provide an electrostatic and/or magnetic field for accelerating the electrons sideways, such as a plate, pair of plates, spatial arrangement of plates or any other geometrical electrode configuration suitable for electrostatic deflection, a (circular or non-circular) coil or coil system. Each of the aligning means and deflector may be operable to deflect the electron beam along a fixed direction (i.e., one-dimensional scan) or in an arbitrary direction (i.e., two-dimensional scan). The focusing means may be a coil or coil system, such as an electromagnetic lens or an electrostatic focusing lens or a combination of both. The focusing power of the focusing means is variable, e.g., by adjusting the intensity of a focusing magnetic/electric field.

In a first and a second aspect, the invention provides an electron-optical system and a method with the features set forth in the independent claims. The dependent claims define advantageous embodiments of the invention.

According to the invention, an electron-optical system of the general type described above further comprises a sensor area and a controller. The controller is configured to perform a sequence of steps, out of which some require the electron target to be active, while some can be practiced equally well whether or not the electron target is active.

In a third aspect, the invention provides a computer-program product that includes a data carrier storing computer-readable instructions for performing the method of the second aspect. In particular, the computer-readable instructions may be executed by a programmable computer communicatively coupled to focusing means, deflection means and a sensor in the electron-optical system in order to carry out the method of the invention.

For the purpose of the appended claims, a "sensor area" may refer to any sensor suitable for detecting the presence (and, if applicable, power or intensity) of a beam of charged particles impinging on the sensor; it may also refer to a portion of such sensor. To mention a few examples, the sensor may be a charge-sensitive area (e.g., conductive plate earthed via ammeter), a scintillator combined with a light sensor, or a luminescent material (e.g., phosphor) combined with a light sensor. The sensor area may be adapted to detect charged particles of the kind forming the beam, in particular electrons.

In one embodiment, the sensor is delimited, e.g., by an electrically conductive screen. The controller is then adapted to perform the following steps:

determining, for one focusing-means setting, a relative position of the outgoing electron beam by deflecting the outgoing electron beam into and/or out of a sensor area arranged a distance downstream of the interaction region and delimited by an electrically conductive screen;

repeating the step of determining a relative beam position for at least one further focusing-means setting and the same aligning-means setting; and evaluating the aligning-means setting by determining the sensitivity of the relative beam position to a change in focusing-means setting.

It is possible to determine with high accuracy whether the electron beam impinges outside the sensor area, partially inside the sensor area or completely inside the sensor area. By deflecting the electron beam into or out of the sensor area while monitoring the sensor signal, it is possible to associate a setting of the deflector with a position of the sensor. Put differently, the position of the electron beam (or rather, of the spot where the electron beam hits the sensor area) relative to the sensor area is determined in terms of particular deflector settings (deflector signal values). It is emphasized that a single-element sensor, in particular one which is delimited by an electrically conductive screen, will accomplish this task. A few-element sensor may also be well suited for performing measurements in connection with this invention. Although a one-dimensional or two-dimensional array of sensor elements may be used for this purpose, this is by no means necessary.

A few examples of such relative positioning are cited:

1. A one-dimensional deflector may be controllable by a single deflector signal, wherein a range of deflector signal values may be associated with a non-zero sensor signal.
2. A one-dimensional deflector which is controllable by a single deflector signal may give rise to a function (curve) associating each deflector signal value with a value of the sensor signal.
3. A two-dimensional deflector may be controllable by a two-component deflector signal, wherein such signal values which give rise to a non-zero sensor signal may be visualized as an region in a two-dimensional coordinate space.
4. Sensor-signal data collected using a two-dimensional deflector controllable by a two-component signal may be summarized as a pair of values representing the center of mass of the region of non-zero sensor signal in a two-dimensional coordinate space. A center of mass may be also be computed in the case of a one-dimensional deflector.
5. Sensor signal data may also be summarized as a set of values representing the boundary of the region of non-zero sensor signal, such as an upper and lower interval endpoint, for a one-dimensional deflector, or a (portion of a) boundary of a planar region, for a two-dimensional deflector.

As is known in the art of optics, a change in the focusing power will be accompanied by a translational movement of the image if the beam is not correctly aligned. The variation in focusing power may also produce a rotation or a non-rigid transformation of the image. With proper beam alignment, it will only be possible to perceive a slight "breathing effect" or magnification and shrinking of the image due to variations in focus. According to the invention, the electron beam is positioned relative to the sensor area while using at least two settings of the focusing means. Hence, it is possible to compute the sensitivity of the relative electron beam position to a change in focusing-means setting. The sensitivity may be defined as the rate of change of the beam position with respect to the focusing-means setting. In a simple form, the sensitivity may be computed as the difference quotient $S=\Delta p/\Delta f$, where $\Delta p$ denotes the change in beam position and $\Delta f$ the change in focusing means setting.

Supposing the focusing means is controllable by one signal, the sensitivity may be computed as follows for the examples recited above:

1. A lower endpoint in the interval is obtained at deflection $x_1$ for focusing power $f_1$ and at $x_2$ for focusing power $f_2$. The sensitivity may be computed as $S=(x_2-x_1)/(f_2-f_1)$.
2. A distinctive feature, such as a point of steepest descent or a maximum, on the function curve corresponds to deflection $x_1$ for focusing power $f_1$ and corresponds to deflection $x_2$ for focusing power $f_2$. The sensitivity may be computed as $S=(x_2-x_1)/(f_2-_1)$.
3. A distinctive feature, such as a corner, is found at deflection $(x_1, y_1)$ for focusing power $f_1$ and is found at deflection $(x_2, y_2)$ for focusing power $f_2$. The quantity $$S=\sqrt{(x_2-x_1)^2+(y_2-y_1)^2}/(f_2-f_1)=\|(x_2,y_2)-(x_1,y_1)\|_2/(f_2-f_1)$$

may be used as a measure of the sensitivity. As a simplified alternative, a simple radial distance $$d_i=\sqrt{x_i^2+y_i^2}$$

may be used, wherein $\Delta p=d_2-d_1$. If measured from an optical axis of the system, the radial distance is equivalent to the axis offset.

4. A center of mass $(x^{(n)}, y^{(n)})$ may be computed as $$x^{(n)}=\sum_i E_i^{(n)}x_i \Big/ \sum_i E_i^{(n)},\ y^{(n)}=\sum_i E_i^{(n)}y_i \Big/ \sum_i E_i^{(n)},$$

where $E_i^{(n)}$ is the sensor signal obtained at deflector setting $(x_i, y_i)$ for focusing power $f_n$. Thus, the sensitivity may be computed on the basis of focusing powers $f_1$ and $f_2$ as $$S_{1,2}=\|(x^{(2)},y^{(2)})-(x_{(1)},y^{(1)})\|_2/(f_2-f_1),$$

where $\|\cdot\|_2$ is the $l^2$ norm appearing above. It is advantageous to use the center of mass as a measure of the relative beam position, since all data points are taken into account, so that robustness and accuracy are furthered. If data for more focusing power settings are available, the total sensitivity may be computed as an average, e.g., $S=(S_{1,2}+S_{1,3}+S_{1,3})/3$.

5. One or more boundary points may be tracked in data collected for different focusing means settings similarly to the processing of the distinctive one-dimensional or two-dimensional points in examples 1, 2 or 3 above.
6. As a variation to point 4 above, edge detection techniques, which are per se known in the art of computer vision, may be utilized in order to determine the location of the boundary of the sensor area. Preferably, the contour of the boundary may then form the basis of a center-of-mass calculation. This method may perform well also in positions where the sensor area is partially obscured.

The present invention may be embodied using a wide range of sensitivity measures, the only important requirement being that aligning-means settings which are relatively more desirable, from a user's or a designer's point of view, will score relatively smaller sensitivity values. For instance, if the focusing means in an electron-optical system is controllable by a vector f of input signals, one may define $\Delta f = \|f_2 - f_1\|_p$, where $\|\cdot\|_p$ denotes an $l^p$ norm, such as the $l^2$ norm. In some embodiments, it may suffice to take only one of the focusing input signals into account.

It is noted that the collection of relative position of the outgoing electron beam need not follow any particular sequence or pattern. For instance, relative positions are available for a set of random measuring points, each of which is defined by an aligning-means setting and a focusing-means setting, then the sensitivity of the relative position to a change in focusing-means setting can be calculated along the following or similar lines:

A function from two to one variables (e.g., a polynomial surface) is fitted to the measurement data, e.g., using the least-squares method.

The point or set of points for which the fitted function has the smallest partial derivative with respect to the focusing-means setting is retrieved by well-known optimum-finding methods.

Alternatively, the relative positions of the outgoing electron beam are collected in a pairwise fashion. As one example, a method according to this embodiment may comprise the following steps:

determining, for one focusing-means setting, a relative position of the outgoing electron beam by deflecting the outgoing electron beam into and/or out of a sensor area arranged a distance downstream of the interaction region and delimited by an electrically conductive screen;

repeating the step of determining a relative beam position for at least one further focusing-means setting and the same aligning-means setting; and evaluating the aligning-means setting by determining the sensitivity of the relative beam position to a change in focusing-means setting.

This way, there will normally be at least two points in the set of measurement data for each aligning-means setting assessed.

In either of the two above cases, the optimization (evaluation) step may proceed subject to a condition on the offset of the outgoing electron beam from the optical axis. In the optimization case, more precisely, the search for a minimum is restricted to that one-dimensional subset of the function values which correspond to the desired offset. Clearly, it may be possible to determine in this manner an aligning-means setting that both provides minimal sensitivity and a desired (e.g., minimal) axis offset.

The invention is advantageous in that the sensor area with its optional screen is arranged a distance away from the interaction region, in which the electron-optical system is adapted to focus the outgoing beam. Thus, the hardware active in the alignment process does not interfere with the normal operation of the X-ray source.

As another advantage of the invention, a sufficient amount of measurements data to achieve proper alignment settings may be acquired by means of a single-element sensor. As discussed above, the relative positioning of the electron beam is carried out by deflecting the beam over a range where it alternately impinges on the sensor area and outside this, e.g., on an electrically conductive screen. Hence, the invention makes it possible to use simple and robust hardware.

It should be noted that the electron target need not be switched off or removed, whichever the case may be, in order for the invention to be practiced. Indeed, even if the electron target may obscure a portion of the sensor area, the outer boundary of the sensor area will be distinctly delimited, e.g., by a screen, so that it is possible to determine a relative position of the electron beam by recording the sensor signal for different deflector settings. Hence, the step of determining a relative position of the outgoing electron beam by causing the deflector to deflect the outgoing electron beam into and/or out of the sensor area may be carried out while the electron target is enabled or while it is disabled.

In one embodiment, the sensor area is arranged at a distance D from the interaction region. The distance D may be chosen with respect to one or more of the following considerations:

physical conditions, e.g., heat, and chemical conditions in the interaction region during operation and the sensor's vulnerability to these, the occurrence of harmful splashes or depositing vapor reaching the sensor area, and sufficient room for manipulating objects in or near the interaction region if needed.

However, the focusing of the electron beam is not an important parameter to consider in choosing D. Indeed, the positioning of the electron beam is not carried out by imaging an object but by deflecting the beam into and out of a distinctively delimited sensor area; such positioning can usually be carried out even if the beam is poorly focused or is much wider than its minimal diameter.

In one embodiment, the electron-optical system further comprises a sensor area arranged a distance downstream of the interaction region and an electrically conductive screen which delimits the sensor area and is adapted to drain electrical charge transmitted to it by electron irradiation or charged debris particles depositing thereon. The system further comprises a controller communicatively coupled to the aligning means, the focusing means and the sensor area and is operable to collect relative position values of the outgoing electron beam at a plurality of aligning-means and focusing means settings.

In one embodiment, the electron-optical system comprises an electrically conductive screen which is maintained at a constant potential. In other words, the screen is adapted to absorb electrical charge without being charged itself. Electric charge depositing on the screen as electrons, ions or charged particles may be drained off the screen to a charge sink. For example, the screen can be an earthed conductive element. The screen may also be an element electrically connected to a charge drain at non-ground potential. It is not essential that the potential, at which the screen is maintained, is absolutely constant; at least small fluctuations do not affect its proper functioning to any significant extent. Furthermore, the potential may be ground potential, a positive or a negative potential. In particular, if the screen is slightly negatively biased, it repels electrons, whereby it acts as a weak negative lens and increases the divergence of the electron beam downstream of the interaction region. Further, if the screen is maintained at a small positive potential, it will attract low-energy electrons outside the main beam, so that measurement noise may be reduced.

In one embodiment, the electrically conducting screen is proximate to the sensor area or located at a relatively small distance. This advantageously provides a well-defined limitation of the sensor area which is substantially independent of the direction of incidence of the beam. In this embodiment, the sensor area may be a subset of a larger sensor which need not have the same shape as the sensor area. As another option, the sensor area may be flush with the screen. The sensor and screen may then be arranged edge to edge. Hence, the screen may be embodied as a portion of a wall in which the sensor is mounted, for example the wall of a vacuum chamber. It is also conceivable, and often preferred, to have the sensor area projecting out from the screen towards the electron beam.

In one embodiment, the electrically conducting screen surrounds the sensor area in all directions. Thus, the projection of the screen onto the plane of the sensor along the optical axis defines an unobscured region that is bounded in all directions. This means that the screen defines the entire boundary of the sensor area, so that the sensor area is distinctly delimited. This embodiment is likely to achieve a higher accuracy than embodiments where the limit of the sensor area itself constitutes the boundary of the sensor area.

In a further development to the preceding embodiment, the sensor area is located behind a bounded aperture in the screen and extends at least a distance $\delta$ outside the projection of the aperture on the sensor area. The distance $\delta$ constitutes a margin ensuring that no ray having passed through the aperture will impinge outside the sensor area and be recorded only partially. The distance $\delta$ may be computed on the basis of a distance L between the screen and the sensor area by $\delta = L \tan \psi$, where $\psi$ is an expected maximum angle of incidence.

In one embodiment, the electrically conducting screen is provided with a circular aperture. The rotational invariance of the circular shape is advantageous if the focusing means rotate the electron beam. More precisely, focusing of a beam of charged particles may be achieved by electrostatic lenses, by magnetic lenses or rotation-free magnetic lenses, or any combination of such electro-optical elements. Electrostatic and rotation-free magnetic lenses may substantially remove the rotation problem, but may have other drawbacks in a desired application. Therefore, if regular magnetic lenses are used as focusing means, the rotating effect may need to be taken into account when measurements are processed. However, when a circular aperture is used, the computations may be simplified, as discussed below. If the circular aperture is centered on the optical axis, further simplification may be achieved.

The extent of the sensor area may be delimited by an electrically conducting screen. It is not necessary that the sensor or sensor arrangement is centered on an optical axis of the electron optical system. An optical axis may be defined by the location of other aligned components of the system, e.g., by a common symmetry axis of the deflection and focusing means. It is not necessary either that the screen defines a sensor area that is centered on the optical axis, but rather it is sufficient for the sensor position to be known relative to the optical axis of the system. In one embodiment, however, the screen has an aperture which is centered on an optical axis of the electron-optical system. With this setup, it is possible to assess both the direction (skew) of the electron beam and its off-axis dislocation. The skew may be measured as the sensitivity of the relative beam position to a change in focusing means setting (e.g., focal length, focusing power). The amount of off-axis dislocation of the beam may be measured with respect to an non-deflected (neutral) direction of the outgoing electron beam. As an alternative, a calibration may comprise defining the neutral direction of the electron beam so that it coincides with the center of the aperture.

In further variations to this, the sensor area may be delimited without using a screen, which advantageously limits the number of components in the system. Firstly, the sensor area may be provided as a front surface of a charge-sensitive body projecting out from a surface insulated from the sensor, such as an earthed housing.

Alternatively, the sensor area may be provided as a non-through hole (or recess or depression or bore) in a body of an electrically conductive material. Electrons impinging into the hole will be subject to lower back-scattering than the surrounding surface and will thus correspond to a relatively higher signal level per unit charge irradiated onto the sensor area. In connection with this sensor type, sensitivity computations in accordance with above point 6 have proved particularly advantageous.

One embodiment relates to an automatic alignment method. After defining a plurality of candidate setting of the aligning means, each of the settings is evaluated by studying the sensitivity of the relative beam position. The method then proceeds to determining an adequate aligning-means setting, which yields a minimal or near-minimal sensitivity, which is the result of the method. The determination of an adequate aligning-means setting may consist in choosing that candidate setting which has been found to provide the smallest sensitivity. The adequate setting may also be derived after an intermediate step of curve fitting, that is, by estimating parameters in an expression assumed to model the relationship between sensitivity and aligning means. The expression may be a linear or non-linear function, such as a polynomial, and the fitting may be performed using a least-squares approach.

One embodiment relates to X-ray sources having a nozzle for producing an electron target, such as a liquid jet. The production of a liquid jet may further involve a pressurizing means and a circulation system, as discussed above. The jet may be a metal jet, an aqueous or non-aqueous solution or a suspension of particles. The width of the electron beam in the interaction region, where it impinges on the electron target, is a property which is important for controlling the X-ray generation process. It is not straightforward to determine the width in the interaction region by means of the sensor area and the screen only, which are located a distance away from the interaction region. This embodiment carries out a width measurement by deflecting the electron beam over the sensor area while the electron target is present and partially obscures the sensor area. Because the electron target obscures or partially obscures a portion of the sensor area, the recorded sensor signal will exhibit a transition between minimal attenuation (unobscured sensor area) and maximal attenuation (behind target) of the beam. The beam width may be derived from this information, in particular from the width of the transition. For example, there may be a known relationship between a change in deflector-means setting and the position of the beam in at the level of the interaction region. The relationship may relate a unit of deflector signal with a displacement (distance) in the interaction region. As an alternative, the relationship may relate a unit change of deflector signal to a change in angle, whereby the displacement in the interaction region can be computed on the basis of the distance from the deflector to the interaction region. Additionally, a cross-sectional geometry of the beam may be taken into account. It is noted that neither continuous deflection movement nor continuous recording of sensor data is essential, as may be the case in a classical knife-edge scan using analogue equipment. Instead, the movement may be step-wise and the sensor data may be sampled at discrete points in time; also, there is no required particular order (such as a linear order) in which the different deflector settings are to be visited during the sensor data acquisition.

The deflection between the free and obscured portions of the sensor area is preferably preceded by a scan permitting to determine an orientation of the electron target. For example, a scan over a two-dimensional area that intersects a liquid jet may provide sufficient information to determine the orientation of the jet. Knowing the orientation, it is possible to either use a normal (perpendicular) scanning direction or compensate an oblique scanning direction in the data processing. The compensation approach, which may be advantageous if the deflector is one-dimensional, may include rescaling the data by the cosine of the angle of incidence relative to a normal of the electron target.

Further preferably, the scanning may be double-sided, so that the electron beam starts in an unobscured portion of the sensor area, enters the electron target completely and reappears on the other side of the target. From the resulting information it is possible to derive both the beam width and the target width. This may provide for an intuitive user interface, where a desired beam position may be input as a percentage of the jet width. Conversely, if the target width is known (and stable, as is relevant in the case of a liquid jet), the electron beam width may be determined in the absence of a relationship between deflector settings and beam locations at the level of the interaction region.

By thus knowing an orientation and a center position of the electron target, it may be possible to process user input relating to the desired beam position in terms of coordinates in a system where an elongated target defines one of the directions. For instance, a user interface may accept as inputs a spot diameter (e.g., 20 μm) and a spot center position (e.g., −30 μm) along a direction normal to a liquid jet; by one embodiment of the present invention, the electron-optical system then determines proper alignment, selects a focusing-means setting which gives the desired spot diameter and deflects the outgoing beam so that the spot is up in the desired position. As a further advantage of the invention, the interface may be configured to refuse to carry out destructive settings that might lead to an excessive electron beam intensity.

In one embodiment, a method of determining a focusing-means setting for obtaining a desired electron-beam width, as measured at the level of the interaction region, in which an electron target is provided and downstream of which a sensor area delimited by an electrically conductive screen is arranged. The electron beam is an outgoing beam from an electron-optical system including focusing means and at least one deflector. The method includes deflecting (scanning) the electron beam between the electron target and an unobscured portion of the sensor area. The electron beam width for the current focusing setting can be derived from the sensor signal.

This method is practicable even if a single-element sensor area is used.

The scanning may be performed between a first position, where the beam impinges on the sensor area unobscured by the electron target, a second position, where the electron target obscures the beam maximally, and a suitable set of intermediate positions. If the recorded sensor data are regarded as a function of the deflection settings, a transition between the unobscured position (large sensor signal expected) and the obscured position (small sensor signal expected) may be identified. The width of the transition corresponds to the width of the electron beam measured at the electron target. A width determined in this manner, in terms of deflector settings, may be converted into length units if a relationship between deflector settings and the displacement of the beam at the level of the interaction region is available.

It is advantageous to perform the scanning in a direction perpendicular to an edge of the electron target; however, oblique scanning directions may be compensated by data processing taking into account the scanning angle against the edge.

It may be possible to extract more detailed information about the electron beam, in particular its shape or intensity profile, by processing the sensor data by Abel transform techniques, which are known per se in the art.

Proper alignment of the system is advantageous though not imperative for practicing the fourth aspect of the invention. As already mentioned, a change in focusing of a poorly aligned beam will be accompanied by a translational movement; however, the image length scale will be affected only to a limited extent so that the beam width can still be determined accurately.

In an advantageous embodiment, the width is determined for a plurality of focusing-means settings. The focusing-means settings may range from a value for which the electron beam waist lies between the electron-beam system and the interaction region up to a value where the waist lies beyond the interaction region. Thus, it will be possible to derive a setting that provides a desired beam width. It will also be possible to minimize the beam width and hence to maximize the intensity for a given total beam power. From this information, it is further derivable whether a particular focusing-means setting will cause the beam to be under-focused or over-focused in this sense.

In a further embodiment, the collection of relative positions of the outgoing electron beam proceeds in accordance with a scheme devised with the aim of minimizing the impact of hysteresis. The characteristics of such a scheme is a low or zero statistical correlation between the sign of an increment leading up to a measuring position (i.e., a point defined by an aligning-means setting and a focusing-means setting) and the location of the measurement position. As will be further detailed below, this may be achieved by adjusting the aligning means and/or the focusing means non-monotonically.

In the embodiments outlined so far, the sensor for sensing the presence of an electron beam spot is located in the downstream direction of the electron beam. The detailed description of example embodiments will also relate to such placement of the sensor which is apparently adapted for sensing charged particles transmitted past the interaction region. However, the invention is not limited to sensors located downstream of the interaction region, but may also be embodied with a sensor for recording back-scattered electrons. A back-scattering sensor may be located relatively close to the optical axis if the geometry of the device so permits, or may be placed separated from the optical axis along a main path of backscattered electrons, as is the usual practice in a scanning-electron microscope. Unlike such microscopes, the invention teaches the use of a perforated screen or a specimen limited in space, spatially fixed with respect to the electron-optical system and acting as an electron scatterer when the electron beam impinges on a portion thereof. Thus, the screen or specimen need not be electrically conductive nor maintained at a constant electric potential; however, this may be advantageous to avoid a charge build-up in the specimen or screen that might otherwise influence its scattering properties, e.g., by repelling electrons. The screen or specimen may be located a distance downstream of the interaction region, wherein the sensor is arranged upstream of this, possibly separated from the optical axis, to be able to capture electrons which are backscattered from the screen or specimen. By monitoring the sensor signal at different deflector settings, one may determine the position of the electron beam relative to the screen or specimen and hence, relative to the electron-optical system. If the invention is embodied with a sensor for recording back-scattered electrons, it may readily be combined with the method for determining a focusing-means setting for obtaining a desired electron-beam width, as discussed above. During the determination of a focusing-means setting, the electron target (e.g., liquid jet) in the interaction region is preferably enabled and acts as scatterer.

It is noted that the invention relates to all combinations of the technical features outlined above, even if they are recited in mutually different claims. Further, the invention may be generalized to equipment adapted to handle beams of other charged particles than electrons.

BRIEF DESCRIPTION OF THE DRAWINGS

Embodiments of the present invention will now be described with reference to the accompanying drawings, on which.

Like reference numerals are used for like elements on the drawings. Unless otherwise indicated, the drawings are schematic and not to scale.

DETAILED DESCRIPTION OF EMBODIMENTS

Figure 1A:
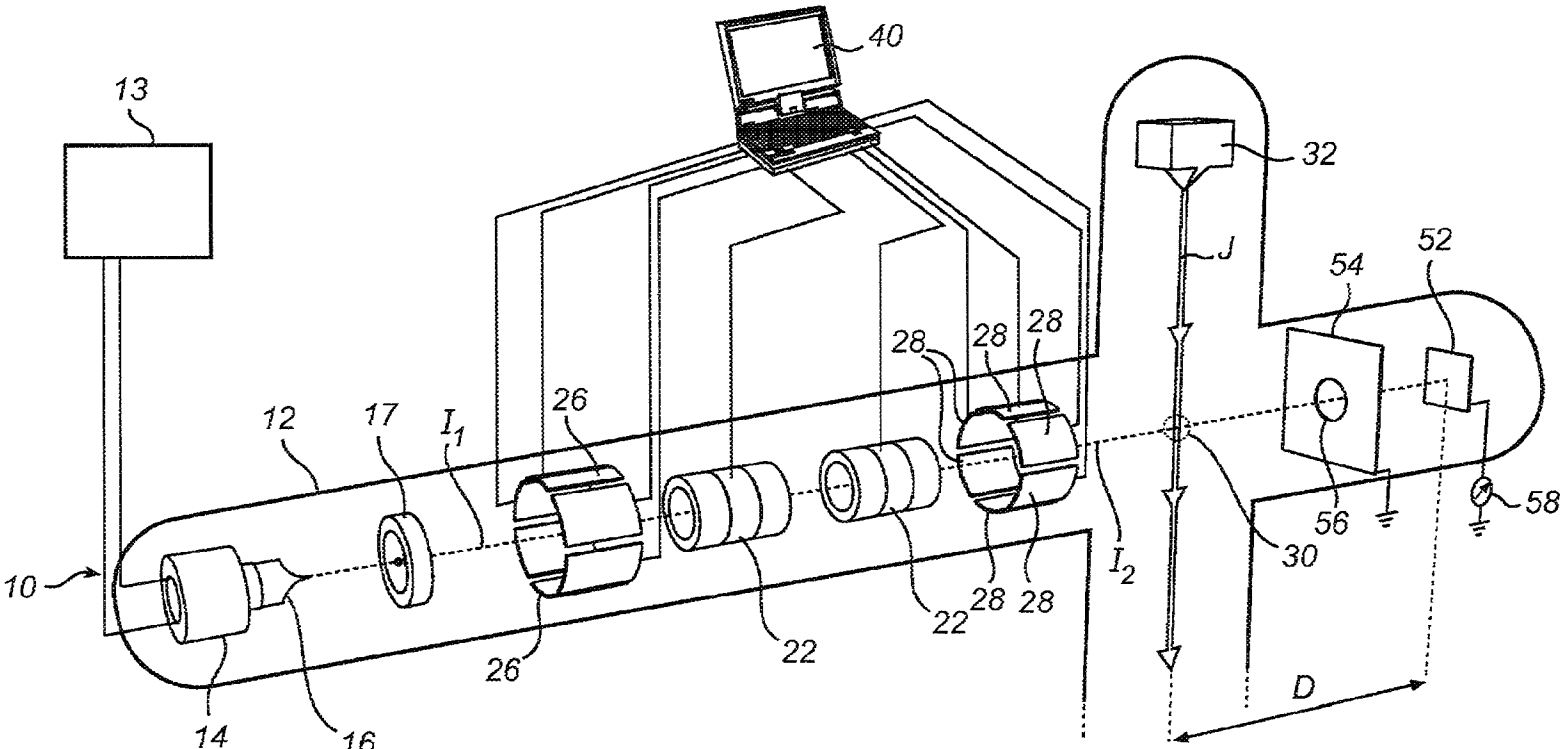
FIG. 1*a* is a diagrammatical perspective view of an X-ray source of the liquid-jet type, in accordance with an embodiment of the invention.

FIG. 1*a* shows an X-ray source 10, generally comprising an electron gun 14-28, means 32 for generating a liquid jet J acting as an electron target, and a sensor arrangement 52-58 for determining a relative position of an outgoing electron beam $I_2$ provided by the electron gun. This equipment is located inside a gas-tight housing 12, with possible exceptions for a voltage supply 13 and a controller 40, which may be located outside the housing 12 as shown in the drawing. Various electron-optical components functioning by electromagnetic interaction may also be located outside the housing 12 if the latter does not screen off electromagnetic fields to any significant extent. Accordingly, such electron-optical components may be located outside the vacuum region if the housing 12 is made of a material with low magnetic permeability, e.g., austenitic stainless steel. The electron gun generally comprises a cathode 14 which is powered by the voltage supply 13 and includes an electron source 16, e.g., a thermionic, thermal-field or cold-field charged-particle source. Typically, the electron energy may range from about 5 keV to about 500 keV. An electron beam from the source 16 is accelerated towards an accelerating aperture 17, at which point it enters an electron-optical system comprising an arrangement of aligning plates 26, lenses 22 and an arrangement of deflection plates 28. Variable properties of the aligning means, deflection means and lenses are controllable by signals provided by a controller 40. In this embodiment, the deflection and aligning means are operable to accelerate the electron beam in at least two transversal directions. After initial calibration, the aligning means 26 are typically maintained at a constant setting throughout a work cycle of the X-ray source, while the deflection means 28 are used for dynamically scanning or adjusting an electron spot location during use of the source 10. Controllable properties of the lenses 22 include their respective focusing powers (focal lengths). Although the drawing symbolically depicts the aligning, focusing and deflecting means in a way to suggest that they are of the electrostatic type, the invention may equally well be embodied by using electromagnetic equipment or a mixture of electrostatic and electromagnetic electron-optical components.

Downstream of the electron-optical system, an outgoing electron beam $I_2$ intersects with a liquid jet J, which may be produced by enabling a high-pressure nozzle 32, at an interaction region 30. This is where the X-ray production takes place. X-rays may be led out from the housing 12 in a direction not coinciding with the electron beam. The portion of the electron beam $I_2$ that continues past the interaction region 30 reaches a sensor 52 unless it is obstructed by a conductive screen 54. In this embodiment, the screen 54
is an earthed conductive plate having a circular aperture 56. This defines a clearly delimited sensor area, which corresponds approximately to the axial projection of the aperture 56 onto the sensor 52. In this embodiment, the sensor 52 is simply a conductive plate connected to earth via an ammeter 58, which provides an approximate measure of the total current carried by the electron beam $I_2$ downstream of the screen 54. As the figure shows, the sensor arrangement is located a distance D away from the interaction region 30, and so does not interfere with the regular operation of the X-ray source 10. The screen 54 and the sensor 52 may be spaced apart in the axial direction, but may also be proximate to one another.

A lower portion of the housing 12, vacuum pump or similar means for evacuating air molecules from the housing 12, receptacles and pumps for collecting and recirculating the liquid jet, quadrupoles and other means for controlling astigmatism of the beam are not shown on this drawing. It is also understood that the controller 40 has access to the actual signal from the ammeter 58.

Figure 1B:
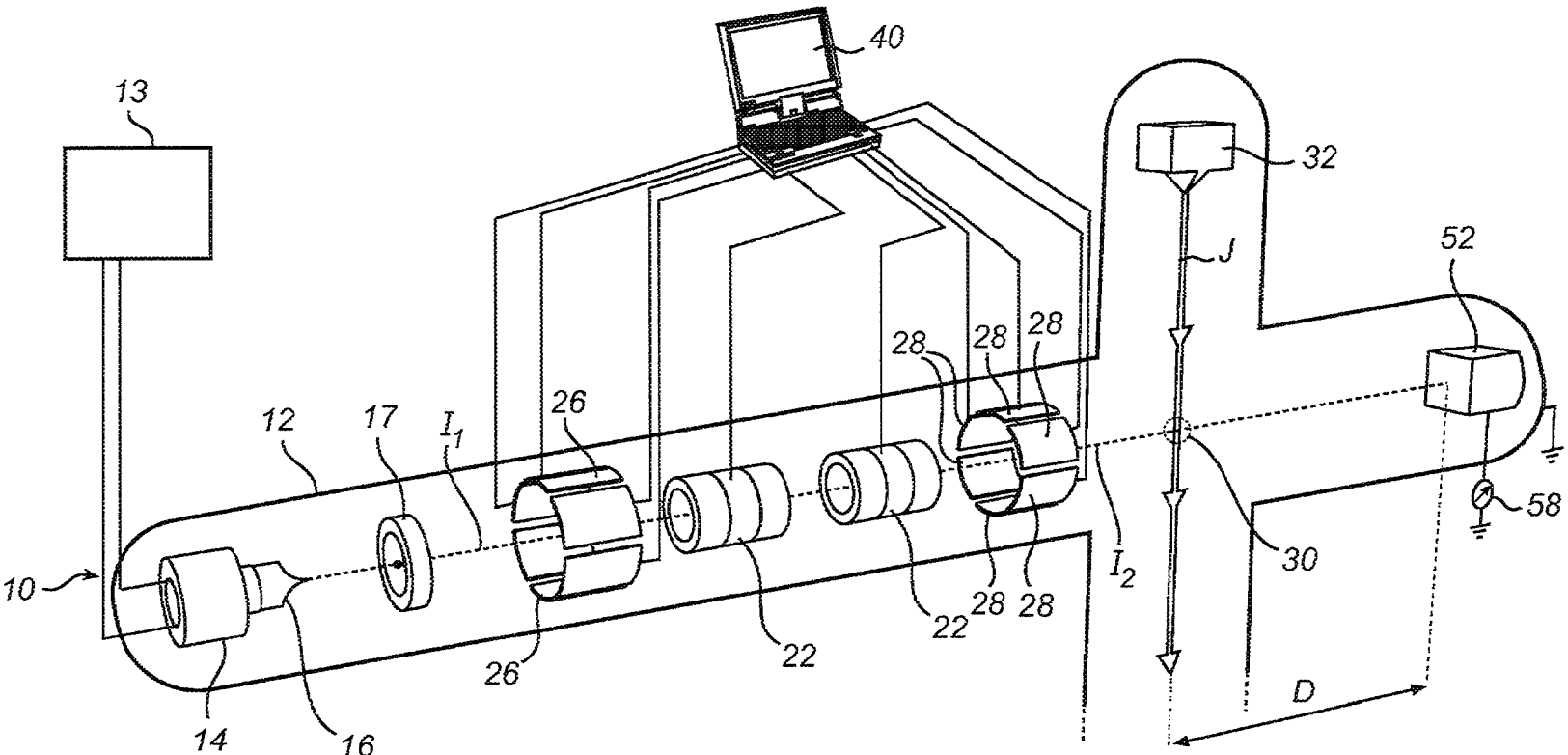
FIG. 1*b* is another diagrammatical perspective view of an X-ray source, in a variation of that shown in FIG. 1*a;*

FIG. 1*b* shows another embodiment, largely similar to that shown in FIG. 1*a*, but in which the sensor 52 and the screen 54 are differently implemented. In this embodiment, there is no separate screen 54. Rather, delimitation of the sensor area 52 is effected by means of the housing 12 in a configuration where the sensor 52 projects out from the inner wall of the housing. Between the sensor 52 and the housing 12, there is electrical insulation, such that a difference in electrical potential between the sensor and the housing can be allowed. Hence, the earthed screen 54 of the embodiment as shown in FIG. 1*a* is not present in the embodiment shown in FIG. 1*b*; the delimitation of the sensor 52 is instead effected by the earthed housing 12. As for the embodiment shown in FIG. 1*a*, an ammeter 58 is used for determining the potential of the sensor. Although the sensor 52 is shown to project out from the inner wall of the housing 12, it should be understood that the sensor could also be mounted flush with the housing wall.

Figure 1C:
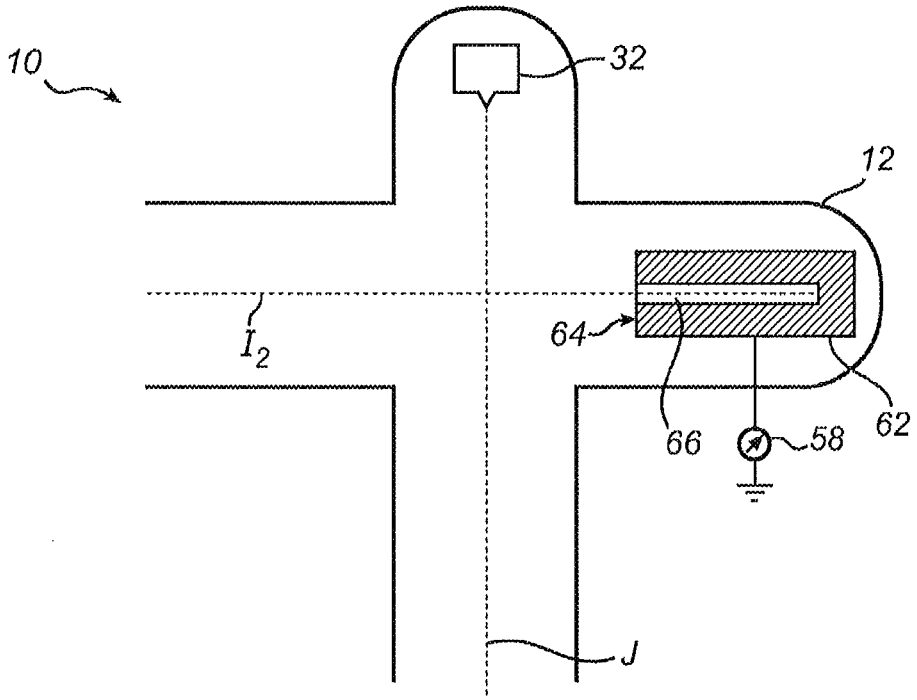
FIG. 1*c* shows a detail of an alternative implementation of an X-ray source of the general type shown in FIG. 1*a;*

FIG. 1*c* shows, according to a further embodiment of the invention, a detail of an X-ray source of the general type described in FIG. 1*a*. The sensor 52 has a different geometry compared to the previous embodiments, which causes it to produce signals that differ as a function of the location of an impinging electron beam. This also avoids the need for a screen 54 altogether. More precisely, the present embodiment includes a screen comprising a body 62 of an electrically conducting material, which is preferably heat- and vacuum-resistant, such as most metals, in particular Cu or W or an alloy containing any of these. The body 62 has a main sensor surface 64 facing the expected main direction of electron impingement (i.e., towards the cathode 14 in the X-ray source 10). In the main sensor surface, there is provided a bore 66 extending in the direction of electron impingement. The bore 66 forms a non-through hole (or recess) in the body 62. Electrons impinging in the bore 66 will experience a substantially lower backscattering rate (i.e., they will be absorbed by the sensor with a higher likelihood) than electrons impinging on the main sensor surface. Hence, the electrons impinging in the bore will not be attenuated by the effect of backscattering to a similar extent, which will manifest itself as a relatively higher response (in terms of signal level) to a given amount of irradiated charge, which achieves an amplification effect. Hence, the mouth of the bore 66 forms a delimited sensor area in the sense of the present invention. Depending on the depth/diameter ratio of the bore 66, the amplification may be made more or less dependent on the angle of incidence, as considered suitable in each intended use case. In the case of an X-ray source 10 with a non-movable cathode 14, the bore 66 is preferably deeper than its diameter, as electrons impinging from directions other than the cathode 14 can be expected to be noise and are preferably filtered out to the greatest possible extent. The geometry of the bore 66 may vary between wide limits; for instance, the shape of the bottom surface in the bore 66 is of very little consequence.

Figure 2A:
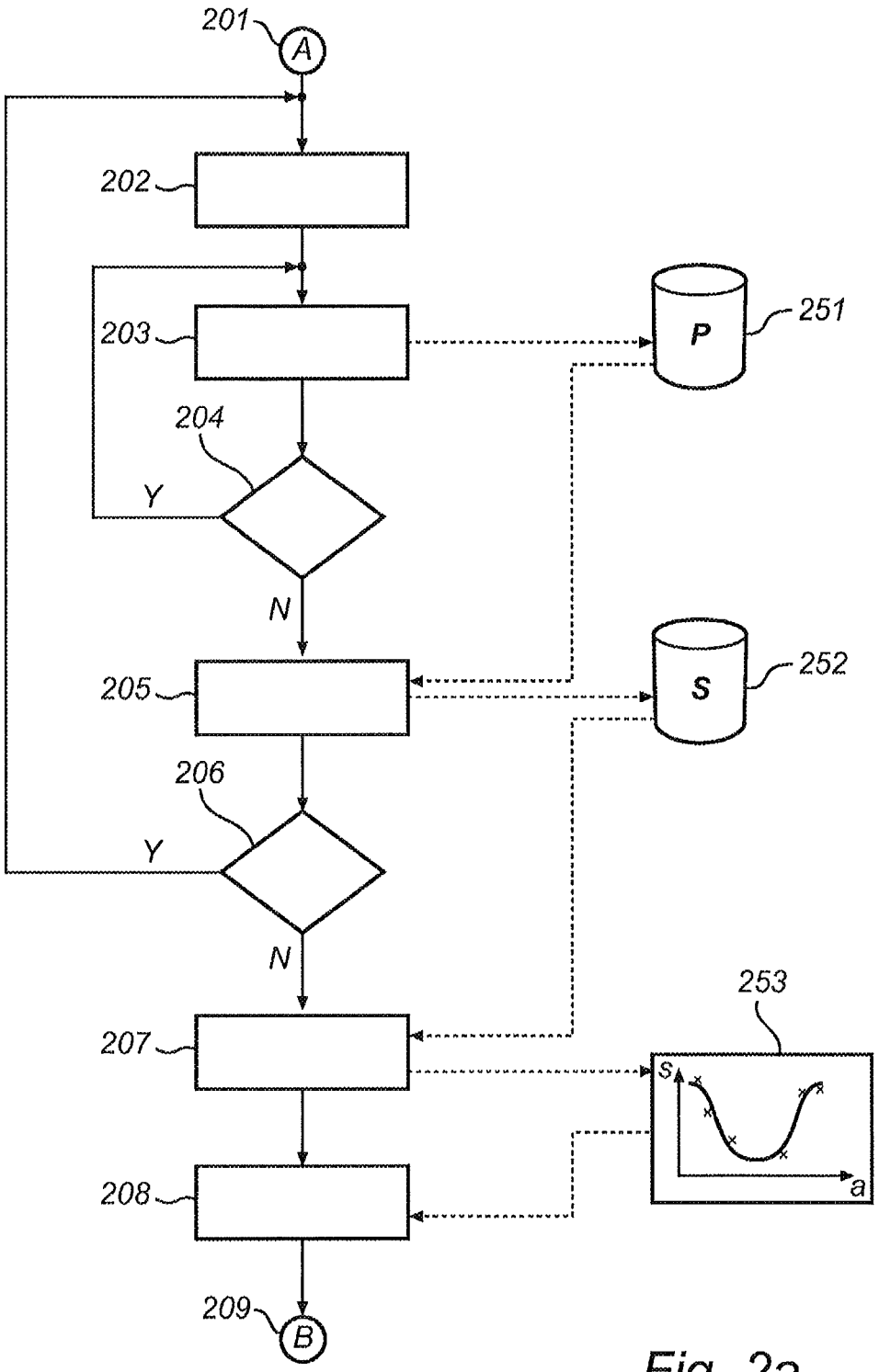
FIGS. 2*a* and 2*b* are flowcharts showing two embodiments of the invention as a method of calibrating an electron-optical system.

FIG. 2*a* illustrates in flow-chart form an algorithm of operating the X-ray source 10 for evaluating a plurality of aligning-means settings and finding an adequate setting. Starting from point "A" 201, the aligning means is set to a first setting $a_1$ in step 202. In step 203, the position of the electron beam relative to the screen 54 is determined for a first focusing-means setting f1, and the result is stored in a positions memory 251. The step 203 of determining a relative position is repeated for at least a second focusing-means setting $f_2$. If there are no further focusing-means settings to be used, which is established in step 204, the algorithm proceeds, in step 205, to computing a sensitivity for this aligning-means setting using the general formula $S=\Delta p/\Delta f$ and storing the result in a sensitivities memory 252. In step 206, it is checked whether the steps up to this point are to be repeated for further alignment-means settings. If not, the algorithm goes on to step 207, where it processes the sensitivity data as a function of the alignment-means setting. In this embodiment, the data points stored in the sensitivities memory 252 are fitted to a function expected to model the behavior of the electron-optical system for the interesting range of values. For example, the data may be fitted to a second-order polynomial 253, the minimum of which is easy to establish. The minimum is determined in step 208 and forms the output of the algorithm. It is noted that the minimum may or may not coincide with any of the alignment settings tried empirically in step 203.

Figure 4A:
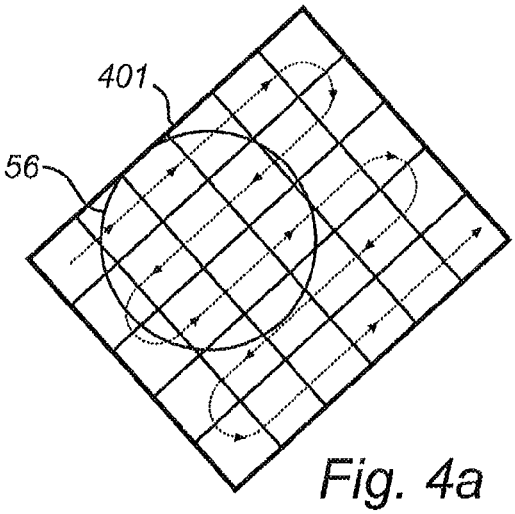
FIGS. 4*a* and 4*b* show a two-dimensional scanning pattern relative to an aperture in a screen delimiting a sensor area, as well as sensor data acquired using this scanning pattern.
Figure 4B:
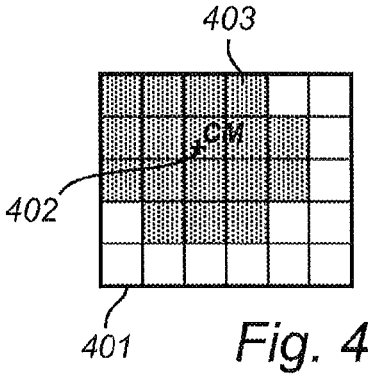
Figure 5A:
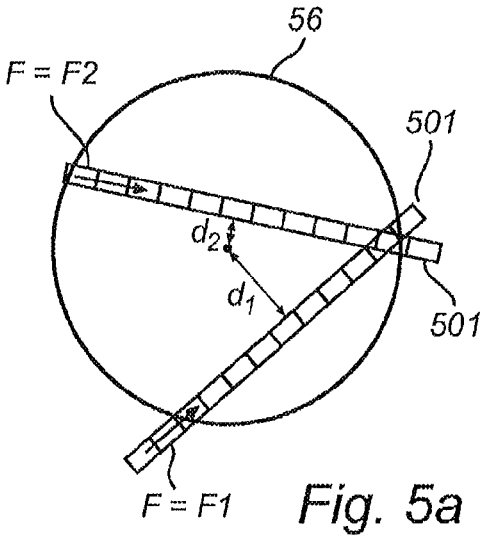
FIGS. 5*a* and 5*b* show, similarly to FIGS. 4*a* and 4*b*, a one-dimensional scanning pattern and associated sensor data.
Figure 5B:
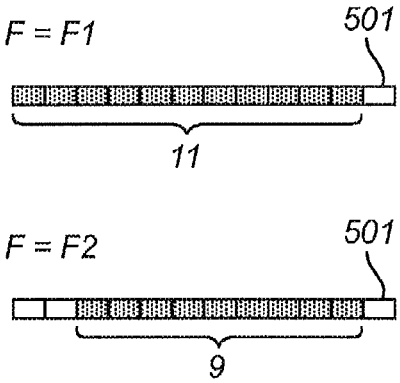

FIGS. 4 and 5 illustrate two possible measuring schemes for determining the relative electron beam position using deflection of the electron beam $I_2$ over a limited sensor area. FIG. 4*a* shows a pixel pattern 401 together with a deflection curve (dotted arrows) to be followed by the electron beam spot on the sensor area. The sensor area is defined as that portion of the sensor 52 which coincides with (the projection of) the aperture 56 in the screen 54. While the pixel pattern 401 is purely imaginary, the deflection curve is shown with a realistic orientation in the plane of the screen 54. FIG. 4*b* shows the pixel pattern 401 with an indication of the measurement results 403 from the scanning shown in FIG. 4*a*. The orientation of the pixel pattern has been adjusted for visibility (by a clockwise rotation of about 45 degrees) and now corresponds to a plot of the presence of a non-zero sensor signal in each signal, which is visualized as a binary-valued function of two variables, namely the X and Y deflector settings. In this example, the relative position of the electron beam is measured by the center of mass "CM" 402 of the non-zero pixels. The position of the center of mass may be expressed as fractions of a pixel. As a further development, the center-of-mass computation may become more accurate if the sensor signal is regarded as a continuous quantity rather than a binary quantity. In this further development, pixels that overlap with the aperture 56 only partially will contribute to a smaller extent to the location of the center of mass.

Analogous to FIG. 4, FIG. 5 shows a pixel pattern 501 in an electron-optical system capable of deflecting the outgoing electron beam in one dimension only. The aperture 56 in the screen 54 is circular and centered on an optical axis of the electron-optical system. The circle is advantageous as an aperture shape since there no need to compensate the relative rotation of the images which may ensue when different focusing settings are used. As shown in FIG. 5*a*, which (apart from the imaginary pixel pattern 501) is a true illustration of the geometry in the plane of the screen 54 or the sensor 52. Apparently, the respective focusing settings $F_1$ and $F_2$ cause the electron beam to rotate by different amounts. Nevertheless, each of the distances $d_1$, $d_2$ from the aperture center to each of the pixel patterns can be estimated on the basis of the radius R of the aperture and the length L of the pattern that overlaps with the aperture, namely by $\sqrt{R^2-L^2/4}$. The overlapping length can be estimated by counting the number of pixels for which a non-zero sensor signal is obtained. Thus, for focusing setting $F_1$, $L_1$=11 pixel widths and for focusing setting $F_2$, $L_2$=9 pixel widths. Although the distances $d_1$ and $d_2$ do not provide complete information of the relative beam position, they may be used as a relative measure for the purpose of determining which one of two aligning means settings is least sensitive to a change in focusing setting, and thus, which one provides the best beam parallelity.

Figure 2B:
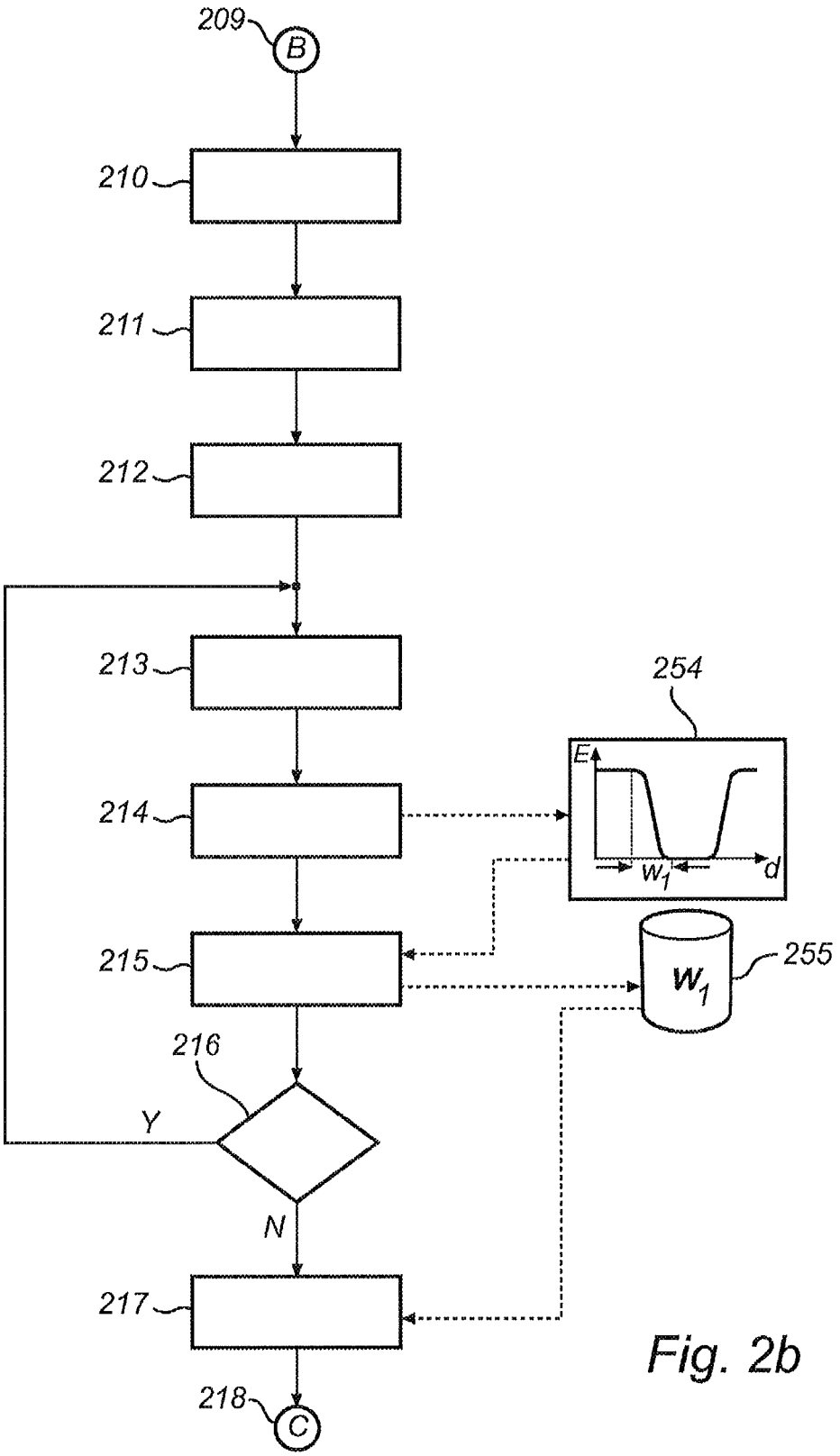
Figures 3A, 3B, 3C:
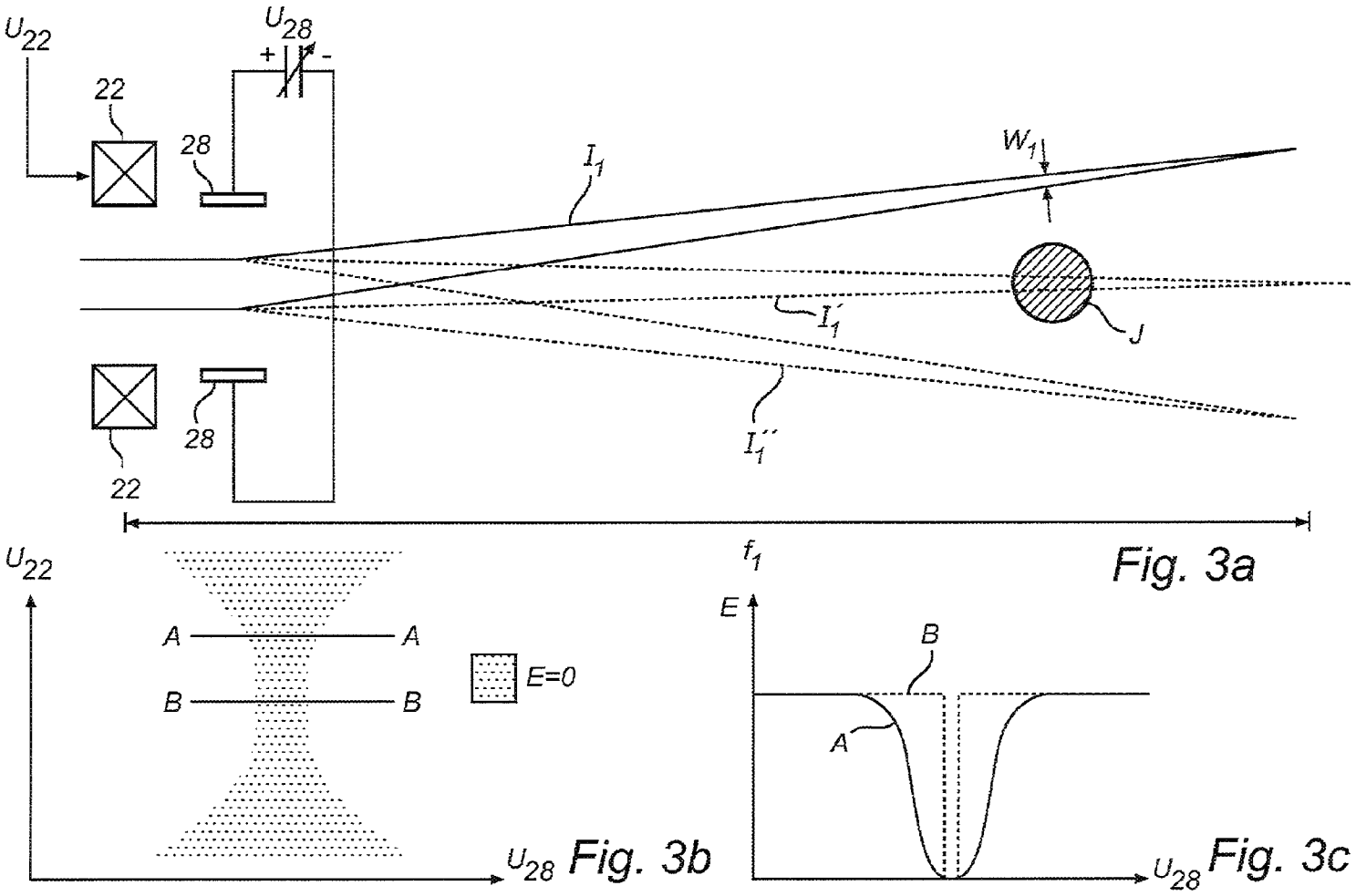
FIG. 3*a* shows, in the plane of deflection, an electron beam at three different deflector settings and the intersection of an electron target with this plane.
FIG. 3*b* is a plot of the sensor signal (after quantization) against combinations of a deflection setting and a focusing setting.
FIG. 3*c* is a continuous plot of the sensor signal against a range of deflection settings combined with two different focusing settings.

FIG. 2*b* shows an algorithm for associating a focusing-means setting with a beam width at the level of the interaction region. The algorithm may be a continuation of the algorithm explained above with reference to FIG. 2*a*, as the letter "B" suggests, or may be carried out independently. In a first step 210, the arrangement of aligning plates 26 is adjusted to an adequate setting, so that the electron beam $I_1$ travels substantially parallel to the optical axis of the electron-optical system and that the position of the outgoing beam $I_2$ depends on the setting of the deflection means 28 but substantially not on the setting of the focusing lenses 22. Then, in step 211, the liquid jet is enabled and, in step 212, the orientation of the deflecting capacity of the deflection means 28 is determined. In normal circumstances, the lenses 22 rotate the electron beam about the lens center during its passage through the focusing field, so that orientation in the outgoing electron beam $I_2$ will differ from that in the incoming beam $I_1$ by an angle that is related to the intensity and axial extent of the focusing field. The liquid jet beam may appear in the measurements as an elongated region of non-filled pixels (that is, pixels having a reduced or near-zero sensor signal E). The direction in which the elongated region extends can be readily determined by processing the values, such as by fitting them to a straight line, whereby the direction of the liquid jet may be related to the coordinate system of the deflection means. This implies in particular that the preferred scanning direction in later step 214, normal to the jet, is known. After this, in step 213, the focusing means 22 is set to a first value $F_1$. In step 214, the electron beam $I_1$ is scanned (deflected) into and/or out of the jet. FIG. 3*a* is drawn in the plane of deflection which is perpendicular to the liquid jet J. The figure shows the beam in three different deflection positions, $I_1$, $I_1'$ and $I_1''$, each of which corresponds to a setting of the deflection means 28. It is emphasized that the angle of the beam has not been drawn to scale, but the beam positions above ($I_1$), inside ($I_1'$) and below the beam ($I_1''$) represent a small angular range, so the beam can be captured by the sensor 52 (not shown in FIG. 3*a*) located further downstream. The quantity to be measured in step 214 is the width $W_1$ of the electron beam at the interaction region. Expressed in deflector setting units, the width $W_1$ is related to each edge of the curve of sensor signal values E when plotted against deflector settings d (e.g., the deflection voltage $U_{28}$ indicated in FIG. 3*a*). The relationship between deflector settings angles or actual lengths at the level of the interaction region can be established by scanning objects located in the interaction region that have known dimensions. In step 215, the beam width is determined and stored in a beam-widths memory 255, either in deflector-settings units or in angular or length units. In step 216 it is determined whether the beam-width scan is to be repeated for other focusing settings $F_2$, $F_3$, . . . . The collection of focusing settings to be examined may be a predefined data set or may determine dynamically, such as by fulfilling the condition of examining both focal lengths that are less than the distance to the liquid jet and focal lengths that are greater than this distance. Such a condition ensures that data sufficient for determining the location of the beam waist are collected. If a desired beam width has been input, the algorithm, in a final step 217, determines at least one focusing-means setting that will produce the desired beam width. Point "C" 218 is the end of the algorithm.

Alternatively, above steps 213, 214 and 215 are performed jointly by recording the sensor signal value E for each of a plurality of points ($U_{28}$, $U_{22}$), where $U_{28}$ is a deflection-means setting and $U_{22}$ is a focusing-means setting. Such a data set is plotted in FIG. 3*b*. If the liquid jet J overlaps with the sensor area, its presence will manifest itself as an area in which the sensor signal E is reduced or near-zero, such as the shaded central region of FIG. 3*b*. At the level of line B, the region has a relatively distinct waist, which corresponds to the electron beam's $I_1$ passage through the liquid jet J when the beam is focused at the liquid jet itself. FIG. 3*b* shows quantized sensor-signal values, which for the sake of clarity have been rounded to either zero or a single non-zero value. A detail of FIG. 3*b* is shown more realistically in FIG. 3*c*, which is a plot of the original (non-quantized) sensor-signal values E against the deflection-means setting $U_{28}$ for two representative focusing-means settings. A first curve A corresponds to the data located on line A-A in FIG. 3*b*, and a second curve B corresponds to the data located on line B-B. It is clear from FIG. 3*c* that the relatively smaller width of the electron beam when optimally focused leads to a sharper transition between the unobscured and the obscured portion of the curve. In other words, a larger portion of the range of deflection-means settings will correspond to either a completely unobscured or a completely obscured position of the electron beam $I_1$ in relation to the liquid jet J.

It is emphasized that the recording of the sensor-signal values E need not proceed along any line similar to lines A-A or B-B or in any particular order. It is in fact preferable to record the values in a non-sequential fashion, so that the impact of any hysteresis in the deflection or focusing means is obviated. In electron-optical equipment, elements containing ferromagnetic material may give rise to such hysteresis due to residual magnetization (or remanence). For instance, it may be advantageous to adjust the focusing-means setting or the deflection-means setting non-monotonically during the measurement session. More precisely, a measurement scheme may be devised in which the share of measuring points for which the concerned focusing-means setting is reached by way of an increment is approximately equal to the share of measuring points for which the setting is reached by way of a decrement. A similar condition may be integrated into the measurement scheme for the deflection-means settings, at least if the deflection means is known to have non-negligible hysteresis. Advantageously, the measuring points reached by way of increments in the concerned quantity are located in substantially the same area and are distributed in a similar manner as the measuring points reached by way of decrements. Put differently, there is a low or zero statistic correlation between the sign of the increment in the concerned quantity (deflection-means setting or focusing-means setting) and the value of the quantity. Alternatively, there is a low or zero statistical correlation between the sign of the increment in the concerned quantity (either of the deflection-means setting and the focusing-means setting) and the combined values of the deflection-means and focusing-means settings.

In a further development of the method described with reference to FIG. 2*b*, the actual liquid jet width is also determined. This may be effected in an analogous fashion, namely by estimating the width of the portion of reduced signal in the curve 254 of sensor-signal values E against deflector settings d.

The following items define further advantageous embodiments.

1. A method of evaluating a setting of aligning means (26) for adjusting a direction of an incoming electron beam ($I_1$) in an electron-optical system adapted to supply an outgoing electron beam ($I_2$) to an electron-impact X-ray source (10), which system further comprises:

a deflector (28) operable to deflect the outgoing electron beam, and focusing means (22) for focusing the outgoing electron beam in an interaction region (30) of the X-ray source, wherein the method comprises the steps of:

determining, for one focusing-means setting, a relative position of the outgoing electron beam by deflecting the outgoing electron beam into and/or out of a sensor area (52) arranged a distance (D) downstream of the interaction region;

repeating the step of determining a relative beam position for at least one further focusing-means setting and the same aligning-means setting; and evaluating the aligning-means setting by determining the sensitivity of the relative beam position to a change in focusing-means setting.

2. The method of item 1, wherein the step of determining a relative beam position includes using a sensor area (52) delimited by a conductive screen (54) and maintaining the conductive screen at a constant potential.

3. The method of item 1 or 2, wherein the step of determining a relative beam position includes using a sensor area delimited by a proximate screen.

4. The method of any one of the preceding items, wherein the step of determining a relative beam position includes using a sensor area delimited by a screen which surrounds the sensor area completely.

5. The method of item 4, wherein the step of determining a relative beam position includes using a sensor area delimited by a screen which defines a circular aperture (56).

6. The method of any one of the preceding items, wherein the deflector and focusing means define an optical axis of the electron-optical system, and wherein the step of determining a relative beam position includes using a sensor area delimited by a screen that has an aperture (56) which is centered on the optical axis.

7. A method of calibrating an electron-optical system for supplying an electron-impact X-ray source, comprising the steps of:

defining a plurality of aligning-means settings;

evaluating each of the aligning-means settings by the method of any one of the preceding items; and determining, on the basis of the sensitivities of said plurality of aligning-means settings, an adequate aligning-means setting which yields a minimal sensitivity.

8. A method of calibrating an electron-optical system for supplying an electron-impact X-ray source, wherein the source is operable to produce an electron target in the interaction region, comprising:

performing the method of item 7 and applying said adequate aligning-means setting; and determining, for at least one focusing-means setting, a width of the outgoing electron beam in the interaction region by enabling the electron target, so that it partially obscures the sensor area from the electron beam, and deflecting the electron beam between the electron target and an unobscured portion of the sensor area, wherein preferably the electron target is a liquid jet.

9. The method of item 8, further comprising the step of determining an orientation of the outgoing electron beam by enabling the electron target, so that it partially obscures the sensor area from the electron beam, and deflecting the electron beam between the electron target and an unobscured portion of the sensor area, wherein the step of determining a width of the electron beam includes deflecting the electron beam in a normal direction of the electron target.

10. A data carrier storing computer-executable instructions for executing the method of any one of the preceding items.

11. An electron-optical system in an electron-impact X-ray source (10), said system being adapted to receive an incoming electron beam ($I_1$) and to supply an outgoing electron beam ($I_2$) and comprising:

aligning means (26) for adjusting a direction of the incoming electron beam;

a deflector (28) operable to deflect the outgoing electron beam; and focusing means (22) for focusing the outgoing electron beam in an interaction region (30) of the X-ray source, a sensor area (52) arranged a distance (D) downstream of the interaction region; and a controller (40) communicatively coupled to the aligning means, the focusing means and the sensor area, said controller being operable to:

determine, for one focusing-means setting, a relative position of the outgoing electron beam by causing the deflector to deflect the outgoing electron beam into and/or out of the sensor area;

repeat said determining a relative beam position for at least one further focusing-means setting and the same aligning-means setting; and evaluate the aligning-means setting by determining the sensitivity of the relative beam position to a change in focusing-means setting.

12. The electron-optical system of item 11, further comprising an electrically conductive screen (54) which delimits the sensor area.

13. The electron-optical system of item 12, wherein the screen is maintained at a constant potential.

14. The electron-optical system of item 12 or 13, wherein the screen is proximate to the sensor area.

15. The electron-optical system of any one of items 12 or 14, wherein the screen surrounds the sensor area completely.

16. The electron-optical system of item 15, wherein the screen defines a circular aperture (56).

17. The electron-optical system of any one of items 12 to 16, wherein:

the deflector and focusing means define an optical axis of the electron-optical system; and the screen has an aperture (56) which is centered on the optical axis.

18. An X-ray source, comprising:

an electron-optical system of any one of items 11 to 16; and a nozzle (32) for producing a liquid jet passing through the interaction region, wherein the controller is further operable to cause the nozzle to produce said liquid jet, so that the jet partially obscures the sensor area from the electron beam, and to cause the deflector to deflect the electron beam between the liquid jet and an unobscured portion of the sensor area.

While the invention has been illustrated and described in detail in the drawings and foregoing description, such illustration and description are to be considered illustrative or exemplary and not restrictive; the invention is not limited to the disclosed embodiments. Variations to the disclosed embodiments can be understood and effected by those skilled in the art in practicing the claimed invention, from a study of the drawings, the disclosure and the appended claims. Any reference signs in the claims should not be construed as limiting the scope.

The invention claimed is:

1. A method in an electron-optical system adapted to supply an outgoing electron beam in an electron-impact X-ray source operable to produce an electron target in an interaction region, the system comprising:

an aligning unit for adjusting a direction of an incoming electron beam;

a deflector operable to deflect the outgoing electron beam; and a focusing unit for focusing the outgoing electron beam in the interaction region;

the method comprising the steps of:

determining, for a plurality of focusing unit settings and aligning unit settings, a respective position of the outgoing electron beam by deflecting the outgoing electron beam into and/or out of a sensor area, which is arranged a distance downstream of the interaction region;

determining, based on the plurality of positions thus determined, an adequate aligning unit setting for which the position has minimal sensitivity with respect to a change in focusing unit setting; and applying an aligning unit setting based on said adequate aligning unit setting.

2. The method of claim 1, further comprising a step of determining an orientation of the outgoing electron beam by ensuring that the electron target partially obscures the sensor area from a deflection range of the electron beam, and further by deflecting the electron beam between the electron target and an unobscured portion of the sensor area.

3. The method of claim 1, further comprising a step of determining, for at least one focusing unit setting, a width of the outgoing electron beam in the interaction region by ensuring that the electron target partially obscures the sensor area from the electron beam, and further by deflecting the electron beam between the electron target and an unobscured portion of the sensor area.

4. The method of claim 3, further comprising the steps of:

receiving a desired electron beam width in the interaction region; and alternately repeating said step of determining a width of the outgoing electron beam in the interaction region and a step of adjusting, responsive thereto, the focusing unit setting with the aim of attaining the desired electron-beam width.

5. The method of claim 3, further comprising a step of minimising the width of the outgoing electron beam in the interaction region by alternately repeating said step of determining a width of the outgoing electron beam in the interaction region and a step of adjusting, responsive thereto, the focusing unit setting with the aim of reducing the width.

6. The method of claim 4, wherein the step of alternately repeating said step of determining a width of the outgoing electron beam in the interaction region and a step of adjusting the focusing unit setting includes adjusting the focusing unit setting non-monotonically for the step of adjusting the focusing unit setting and adjusting a deflection unit setting non-monotonically for the step of determining a width of the outgoing electron beam in the interaction region.

7. The method of claim 1, wherein said adequate aligning unit setting is determined subject to a condition on an offset of the electron beam with respect to an optical axis defined by the deflector and focusing unit.

8. The method of claim 1, wherein the step of determining a respective position for a plurality of focusing unit settings and aligning unit settings comprises the sub-steps, to be performed for each of said plurality of aligning unit settings, of:

determining, for one focusing unit setting, a position of the outgoing electron beam by deflecting the outgoing electron beam into and/or out of the sensor area; and repeating the step of determining a beam position for at least one further focusing unit setting and the same aligning unit setting.

9. The method of claim 1, wherein the electron target is a liquid jet.

10. A non-transitory computer-readable medium storing computer-executable instructions for executing the method of claim 1.

11. An electron-optical system in an electron-impact X-ray source operable to produce an electron target in an interaction region, said system being adapted to receive an incoming electron beam and to supply an outgoing electron beam and comprising:

an aligning unit for adjusting a direction of an incoming electron beam;

a deflector operable to deflect the outgoing electron beam; and a focusing unit for focusing the outgoing electron beam in the interaction region;

a sensor area; and a controller communicatively coupled to the aligning unit, the deflector, the focusing unit, and the sensor area;

said controller being operable to:

determine, for a plurality of focusing unit settings and aligning unit settings, a respective position of the outgoing electron beam by deflecting the outgoing electron beam into and/or out of the sensor area, which is arranged a distance downstream of the interaction region;

determine, based on the plurality of positions thus determined, an adequate aligning unit setting for which the position has minimal sensitivity with respect to a change in focusing unit setting; and apply an aligning unit setting based on said adequate aligning unit setting.

12. The electron-optical system of claim 11, wherein the controller is communicatively coupled to the electron target and adapted to determine an orientation of the outgoing electron beam by ensuring that the electron target partially obscures the sensor area from a deflection range of the electron beam, and further by deflecting the electron beam between the electron target and an unobscured portion of the sensor area.

13. The electron-optical system of claim 11, wherein the controller is communicatively coupled to the electron target and adapted to determine, for at least one focusing unit setting, a width of the outgoing electron beam in the interaction region by ensuring that the electron target partially obscures the sensor area from the electron beam, and further by deflecting the electron beam between the electron target and an unobscured portion of the sensor area.

14. The electron-optical system of claim 11, wherein the sensor area is delimited.

15. The electron-optical system of claim 14, further comprising an electrically conductive screen which delimits the sensor area.

16. The electron-optical system of claim 15, adapted to maintain the screen at a constant potential.

17. The electron-optical system of claim 15, wherein the screen is arranged at a distance from the sensor area.

18. The electron-optical system of claim 11, further comprising a wall having a projection on which the sensor area is provided, wherein the sensor area is electrically insulated from the wall.

19. The electron-optical system of claim 11, further comprising a recess, which is provided in a charge-sensitive surface and which forms the sensor area.

20. An X-ray source, comprising:

an electron-optical system of claim 11; and a nozzle for producing a liquid jet passing through the interaction region and acting as the electron target, wherein the production of the liquid jet is controllable by the controller.

* * * * *